US007146937B2

(12) United States Patent
Kraus et al.

(10) Patent No.: US 7,146,937 B2
(45) Date of Patent: Dec. 12, 2006

(54) COMBUSTION CHAMBER DESIGN WITH WATER INJECTION FOR DIRECT-FIRED STEAM GENERATOR AND FOR BEING COOLED BY THE WATER

(75) Inventors: Timothy James Kraus, Hedrick, IA (US); Eric Ryan Lang, Donnellson, IA (US); Walter Mark Schlesser, Ottumwa, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/108,503

(22) Filed: Apr. 18, 2005

(65) Prior Publication Data

US 2006/0000427 A1 Jan. 5, 2006

Related U.S. Application Data

(63) Continuation-in-part of application No. 10/883,865, filed on Jul. 2, 2004, now abandoned.

(51) Int. Cl.
*F22G 5/12* (2006.01)

(52) U.S. Cl. ..... 122/40; 122/487

(58) Field of Classification Search ..... 122/40, 122/446, 448.1, 487, 41, 452, 436; 432/73, 432/79, 82, 87, 209, 225
See application file for complete search history.

(56) References Cited

U.S. PATENT DOCUMENTS

| | | | | |
|---|---|---|---|---|
| 2,634,115 | A * | 4/1953 | Bartu et al. | 432/73 |
| 3,980,137 | A | 9/1976 | Gray | |
| 4,118,172 | A | 10/1978 | Noir et al. | |
| 4,156,421 | A | 5/1979 | Cradeur et al. | |
| 4,211,071 | A | 7/1980 | Wyatt | |
| 4,285,666 | A * | 8/1981 | Burton et al. | 431/347 |
| 4,288,978 | A | 9/1981 | Wyatt | |
| 4,706,611 | A | 11/1987 | Nelson | |
| 4,884,529 | A | 12/1989 | Byrnes | |
| 4,989,551 | A | 2/1991 | Sardoff et al. | |
| 6,733,278 | B1 | 5/2004 | Welden | |

* cited by examiner

*Primary Examiner*—Gregory Wilson

(57) ABSTRACT

A direct-fired steam generator body defines a combustion chamber and having an exhaust outlet. A mixing chamber is provided for receiving the exhaust gases from the combustion chamber. A flange joint between an elbow forming part of the mixing chamber and the end of the steam generator body defining the exhaust outlet is designed so as to be cooled by process water coupled to the joint by an injection port provided in one of the flanges.

10 Claims, 7 Drawing Sheets

COMBUSTION CHAMBER DESIGN WITH WATER INJECTION FOR DIRECT-FIRED STEAM GENERATOR AND FOR BEING COOLED BY THE WATER

RELATED APPLICATION

This is a continuation-in-part of application Ser. No. 10/883,865 filed, 02 Jul., 2004 now abandoned.

FIELD OF THE INVENTION

The present invention relates to direct-fired steam generators, and more specifically relates to a way of cooling, and of metering process water into the hot combustion gases at, an exhaust end of the combustion chamber.

BACKGROUND OF THE INVENTION

A direct-fired steam generator usually comprises a system formed from three parts, namely, a burner head, a combustion chamber, and a straight, or elbow-forming, tubular mixing chamber. Except for the mixing chamber, U.S. Pat. No. 4,211,071 discloses such a steam generator. Considerable heat is generated in the burner head, combustion chamber and mixing chamber While the patented structure includes a water jacket for cooling the length of the combustion chamber, the bottom wall, which contains a centrally located exit outlet for conveying steam and hot combustion gases, is not adequately cooled. A solution to this cooling problem is disclosed in U.S. Pat. No. 3,980,137, wherein a bottom combustion chamber wall is made of upper and lower sections constructed for being clamped together to form an annular passage for receiving cooling water. However, this solution is somewhat costly.

Both of the aforementioned patented structures introduce feed water into the combustion chamber by having it enter from the top of the water jacket through a small gap provided between the top wall of the combustion chamber and the inner wall of the water jacket. This feed water then runs down the inner surface of the inner wall. This water flow serves the purposes of providing secondary cooling to the combustion chamber, and of introducing water into the hot products of combustion so that it changes to steam while preventing water from coming in direct contact with the flame, such direct contact being undesirable since it would negatively affect combustion. While this may be a suitable way to introduce feed water into a static combustion chamber, it has been found that in a mobile application, such as when the steam generator is being used to generate steam to re-hydrate crop just before baling, for example, the terrain traversed by the generator carrying vehicle may result in the combustion chamber becoming tilted, which causes an uneven flow of feed water along the inner wall of the combustion chamber. The result of uneven flow is that a portion of the water prematurely flashed to steam in the combustion chamber. As water flashes to steam, the water leaves behind solid particles (mineral deposits) on the combustion chamber walls and the steam disrupts the flame. The mineral deposits build up over time and will cause water flow and heat transfer issues resulting in unacceptable steam generator system performance. In addition, when water flow is disrupted, hot spots can occur in some designs on the lower parts of the combustion chamber which are not cooled by the water-jacket. Yet another disadvantage of this design is the abrupt transition at the bottom wall of the combustion chamber to go from the diameter of the combustion chamber to the smaller diameter of the exit conduit. This abruptness causes turbulence which requires an increase in burner blower power to move the combined steam and combustion gases through the system. Available power for implements can be very limited, especially in older machines; therefore, a design with excessive power requirements has little practicality for use in some mobile applications.

The aforementioned drawbacks associated with the known design has been solved in part by another known system wherein the feed water is injected as a fine mist or spray into the bottom zone of the combustion chamber at the tip of the flame, but the problem remains that the flat bottom wall of the combustion chamber still becomes too hot due to the fact that hot combustion gases impact the wall and must abruptly move to the middle of it before exiting. In this known steam generator layout, the bottom of the combustion chamber and an end of an exit conduit were each provided with a flange and these flanges were clamped and sealed to opposite faces of a water injection ring penetrated by a radially extending feed water pipe terminating at a discharge nozzle located centrally within the ring so as to meter water into a zone at the bottom of the combustion chamber. However, the flanges were found to reach an unacceptable temperature in the neighborhood of 735° F.

The problem to be solved then is to find a way to reduce the operating temperature of the exterior surfaces of the combustion chamber and exit conduit, located in the region of the bottom of the combustion chamber, to an acceptable temperature.

SUMMARY OF THE INVENTION

According to the present invention, there is provided an improved steam generator wherein the exterior surfaces of the components making up the combustion chamber and mixing chamber exhibit acceptable exterior working temperatures.

An object of the invention is to shape the combustion chamber, so as to eliminate the bottom wall.

A further object in conjunction with that just mentioned is to route the feed or process water, i.e., that water which is being changed to steam, in such a way as to cool the flanges used to connect the combustion chamber to the mixing chamber.

The above objects are achieved by providing the combustion chamber with a conical, lower wall section that gradually reduces the interior diameter of the combustion chamber to that of the interior diameter of the exit conduit, thereby obviating the need for a bottom wall, and by providing a flange joint designed for injecting water into the lower region of the combustion chamber while being cooled by the water before it is injected.

According to the invention, the flange joint design includes a spacer ring located between the flanges in concentric spaced relationship to a sealing gasket so as to form a water passage between the gasket and spacer ring. In one embodiment, the spacer ring has a thickness approximately the same as that of the gasket and is provided with spaced ends so as to permit water to flow into the zone between the combustion chamber and the mixing chamber. In another embodiment, the spacer is made so as to have a thickness somewhat less than that of the gasket, thereby permitting water to be metered in the gap left between the spacer and the flanges. In yet another embodiment, the gasket is replaced by two spacers having cooperating profiles which result in the water being channeled about the flange and into the zone between the combustion and mixing chambers.

Instead of using spacer rings, grooves could be formed in one or the other or both of the flange faces so as to channel the water about the faces and into the zone between the combustion chamber and the mixing chamber.

DESCRIPTION OF THE PREFERRED EMBODIMENT

Figure 1:
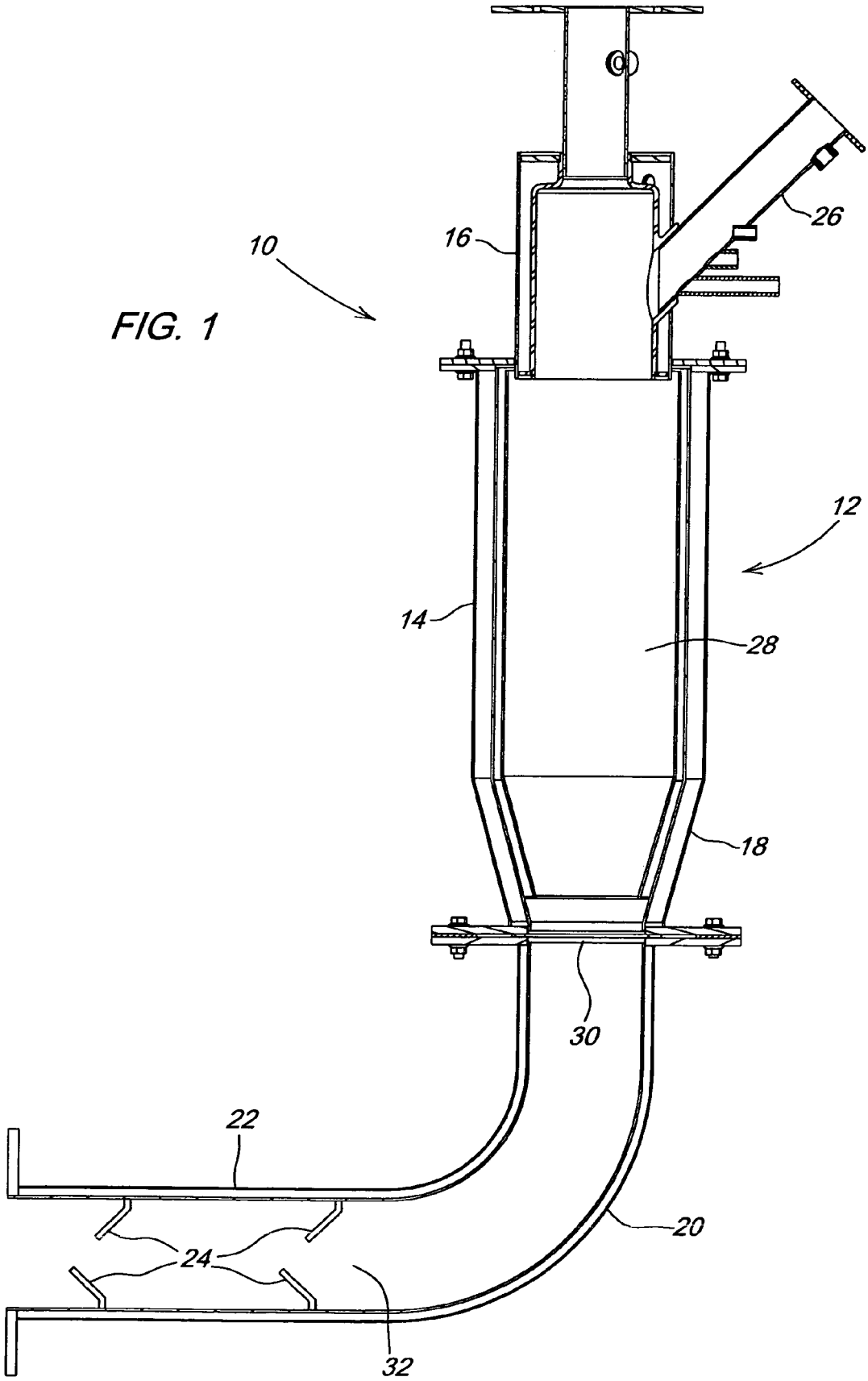
FIG. 1 is a schematic sectional view showing the steam producing components of a direct-fired steam generator constructed in accordance with the principles of the present invention.

Referring now to FIG. 1, there is shown a portion of a direct-fired steam generator 10 including a steam generator body 12 having a relatively long cylindrical inlet section 14 to which a cylindrical burner head 16 is coupled, and having a relatively short conical outlet section 18. An elbow 20 is coupled between the outlet section 18 of the body 12 and a tubular static mixer 22 containing mixing fins or baffles 24 having a purpose explained in more detail below.

The burner head 16 includes a pilot burner tube 26 located such that it communicates with a lower region of the burner head 16. An igniter (not shown) is mounted so as to terminate within a lower region of the pilot burner tube 26. The igniter may be a spark plug or other type of sparking device, which operates to selectively ignite a fuel/air mixture selectively metered into an upper end of the pilot burner tube 26. When this mixture is ignited, it in turn acts to ignite a fuel/air mixture metered into an upper end of the burner head 16, with this resulting in a main flame being created in a combustion chamber 28 defined by the generator body 12. Steam is created by injecting water, in a manner described below, into hot combustion gases at a zone 30 where the small or exhaust end of the combustion chamber 28 joins an entrance of a mixing chamber 32 defined by the elbow 20 and the static mixer 22. It can be seen that the inside diameter of the conical outlet section 18 of the steam generator body 12 gradually tapers to an exit end having a diameter equal to the inside diameter of the elbow 20. Therefore, no bottom wall is present at the bottom of the steam generator body 12 to impede the flow of combustion gases, with the tapered shape of lower end of the combustion chamber 28 promoting an increase in combustion gas velocity without requiring excessive burner blower power.

It is to be noted that each of the generator body 12, the burner head 16 and the elbow 20 are constructed with double walls so as to form respective water jackets which are interconnected to each other by connecting lines (not shown) and are connected to a pressurized source of process water, delivered by a water pump (not shown), for example, so that these jacketed components are cooled so as to be maintained within an acceptable operating temperature range.

Figure 2:
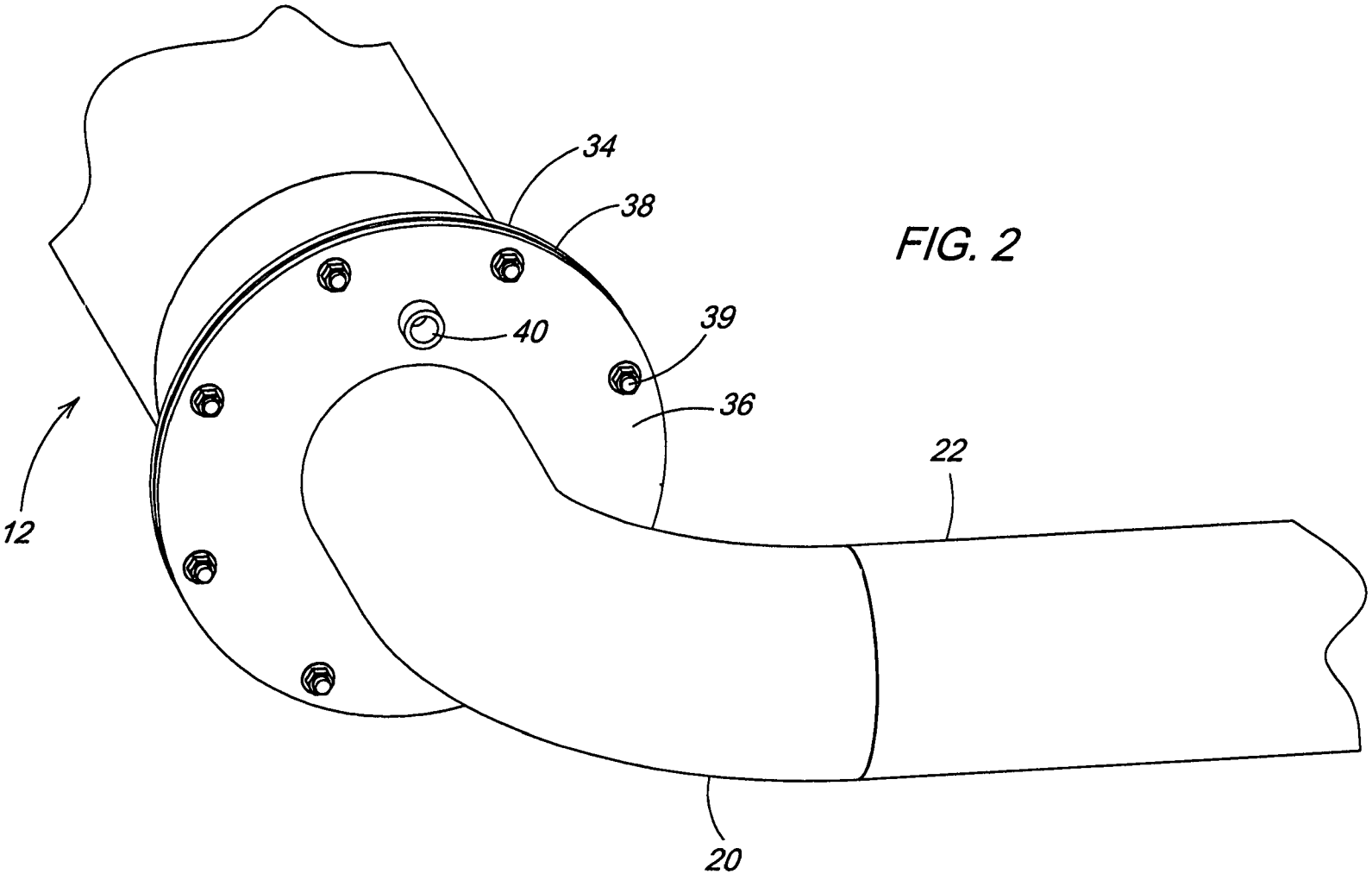
FIG. 2 is a perspective view showing the flange joint formed between the exhaust end of the combustion chamber and the exit conduit forming the tubular mixing chamber of the direct-fired steam generator.

Referring now also to FIG. 2, it can be seen that the conical outlet section 18 of the steam generator body 12 is provided with a mounting flange 34 and the elbow 20 is provided with a similar mounting flange 36, the flanges 34 and 36 being clamped together in sandwiching relationship to an annular flat gasket 38 by a plurality of bolts 39 inserted through aligned holes in the flanges 34 and 36. A water injection port 40 is provided at the twelve o'clock position in the mounting flange 36. However, the port 40 could just as well be provided in the mounting flange 34.

Up to this point, except for the water injection port 40, the described structure of the direct-fired steam generator 10 is conventional. What follows is the novel structure designed for effecting cooling of the flanges 34 and 36.

Figure 3:
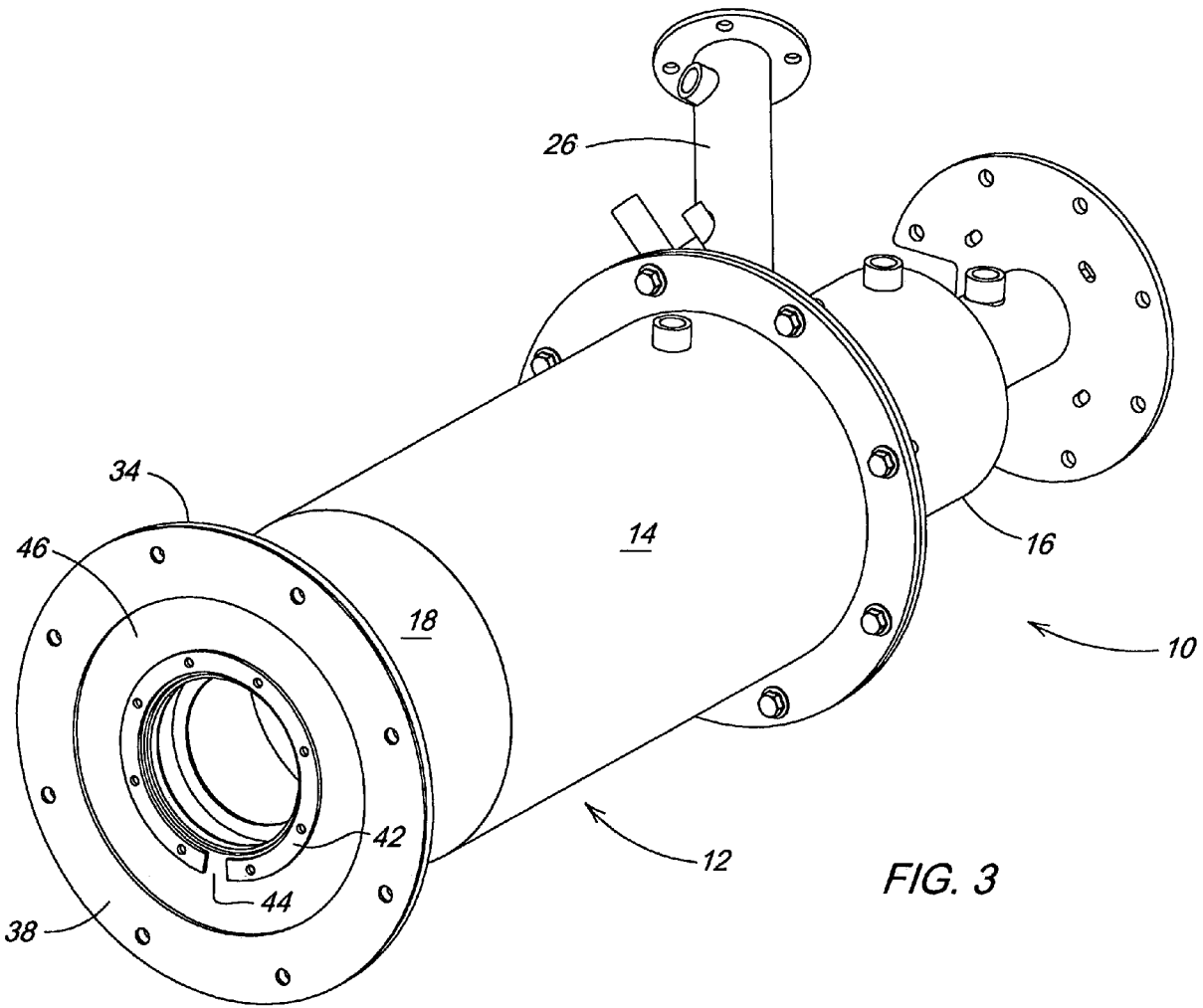
FIG. 3 is a perspective view showing the combustion chamber with a flange gasket and spacer plate located against the mounting flange at the exhaust end of the combustion chamber.

Specifically, with reference to FIG. 3, it can be seen that a C-shaped spacer plate 42 is located against the mounting flange 34 of the steam generator housing 12 in concentric relationship to the gasket 38, with a gap 44 defined between opposite ends of the plate 42 being disposed at the six o'clock position. The spacer plate 42 has a thickness which is approximately equal to that of the gasket 38 when the latter has been compressed between the flanges 34 and 36. The spacer plate 42 has an outside diameter spaced from an inner diameter of the gasket 38 so as to define an annular recess or channel 46, which, when covered by the flange 36 of the elbow 20, cooperates with the flange 30 to define a passage through which water may flow, from the water injection port 40 into the zone 30 at the exhaust end of the combustion chamber 28 by way of the gap 44 so as to be contacted by hot exhaust gases and changed to steam, with this contact with hot exhaust gases being enhanced by the vanes 24 of the static mixer 22. According to the disposition of the generator body 12, it may be desirable to place the injection port 44 and/or the gap 44 at different locations so as to obtain the most effective water flow for cooling the flanges 34 and 36.

It is to be noted that a variant of the spacer plate 42 may be provided wherein the thickness of the plate 42 is somewhat less than that of the gasket 38. In this case, an annular recess is still formed for permitting water to flow so as to contact confronting, annular regions of the faces of the flanges 34 and 36. However, since the spacer plate 42 has a thickness less than that of the gasket 38, water may enter the zone 30 by flowing radially across the spacer plate 42. Thus, if desired, the spacer plate 42 may be constructed as a complete ring where the gap 44 is eliminated.

Figure 4:
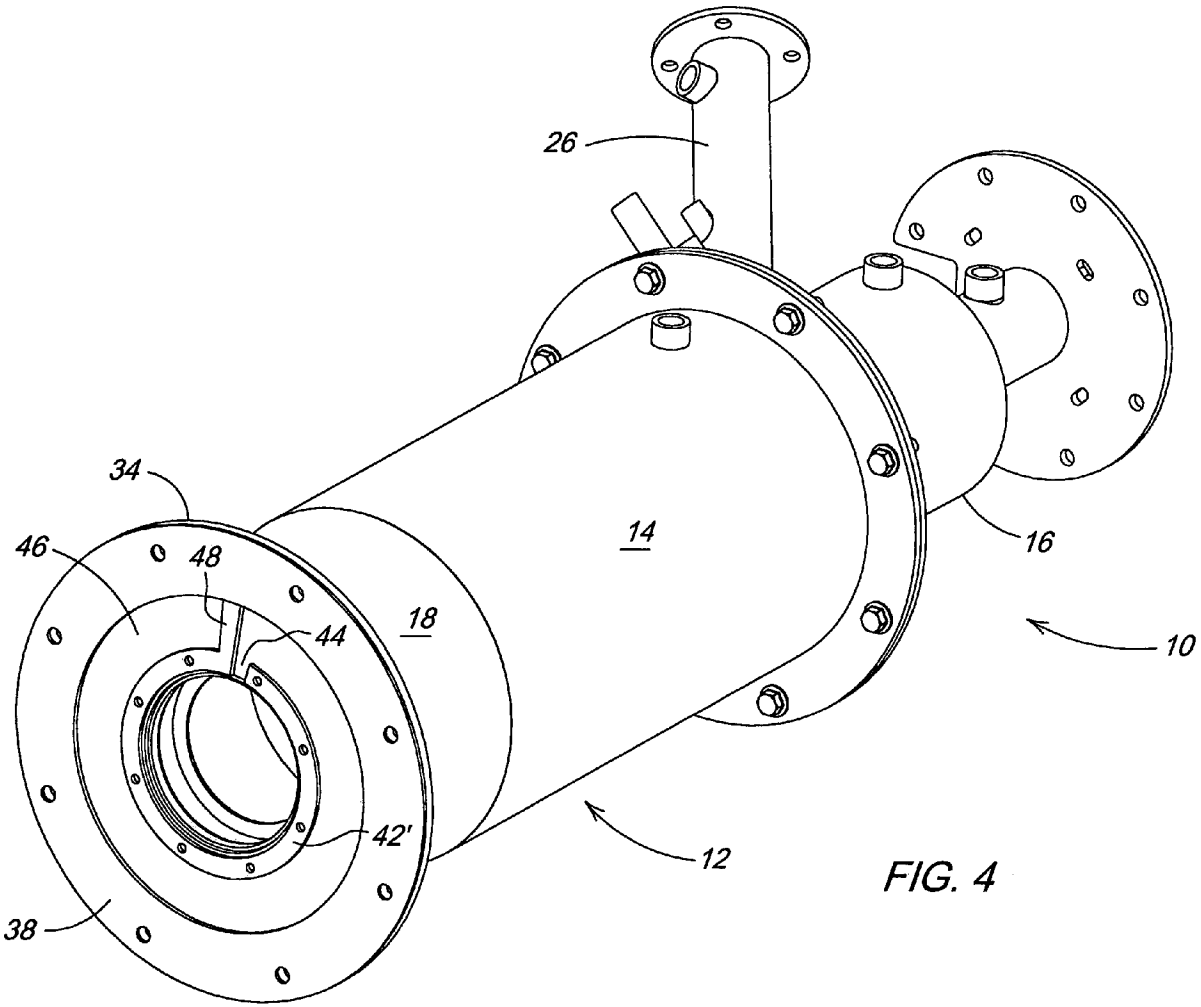
FIG. 4 is a perspective view like FIG. 3 but showing a spacer plate having a different shape than that shown in FIG. 3.

Referring now to FIG. 4, a spacer plate 42' is shown which differs from the previously described spacer plate 42 in that the spacer plate 42' is oriented such that the gap 44 is located at approximately the one o'clock position so as to be rightward of the water injection port 40. Further, a radial projecting bridge section 48 is joined to one end of the spacer plate 42 so as to span the recess 46 at a location rightward of where water is injected into the passage defined in part by the recess 46 so that the injected water is forced to flow counterclockwise until it reaches the gap 44.

Figure 5:
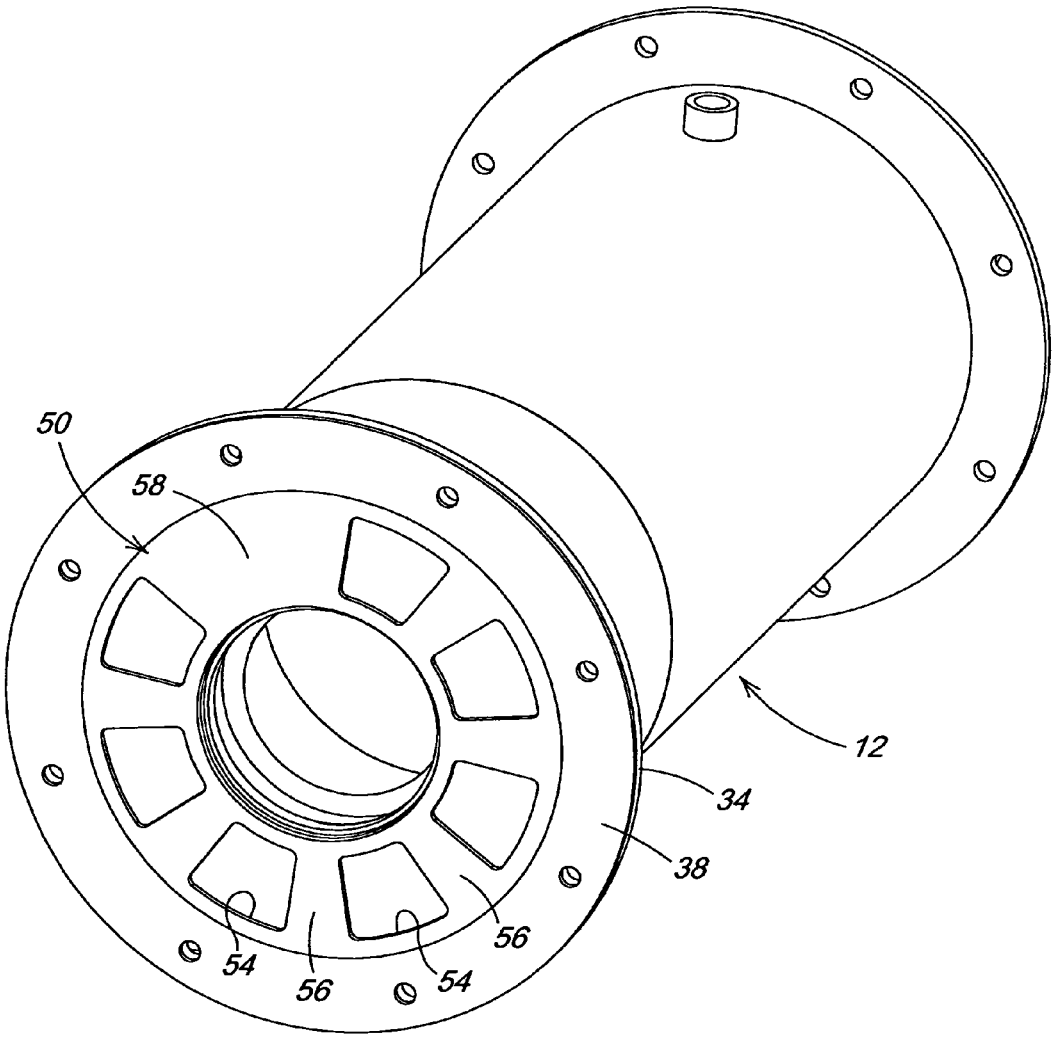
FIG. 5 is a perspective view of the combustion chamber showing a plate having a first pattern of openings fixed to the mounting flange used for securing the combustion chamber to the mixing chamber.
Figure 6:
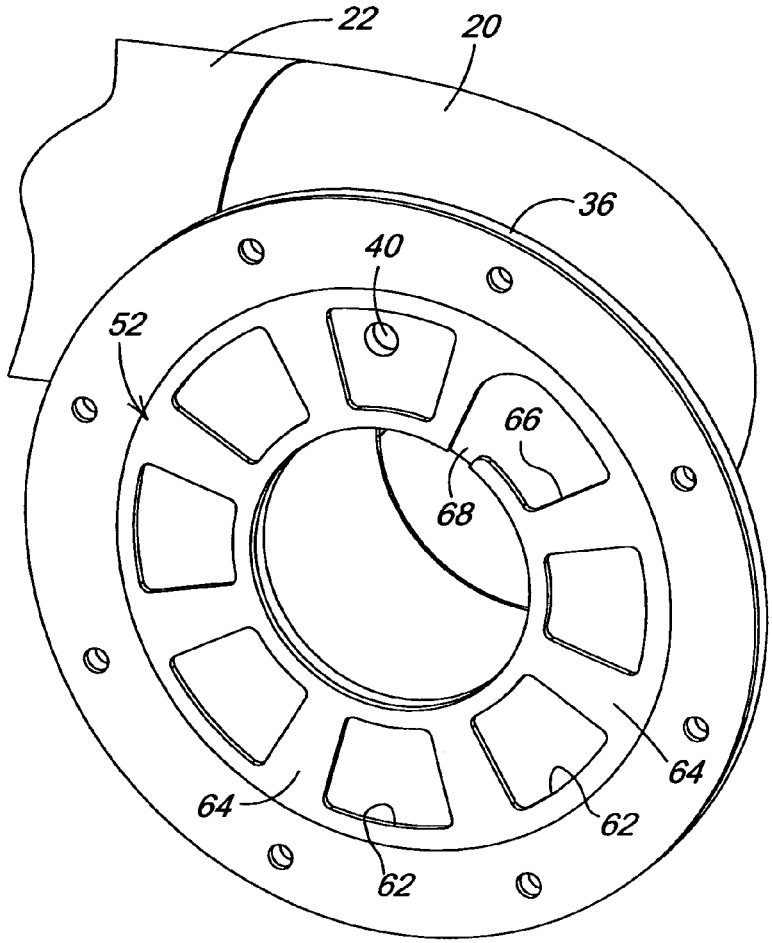
FIG. 6 is a perspective view of the mixing chamber showing a plate having a second pattern of openings fixed to the mounting flange used for securing the mixing chamber to the combustion chamber.
Figure 7:
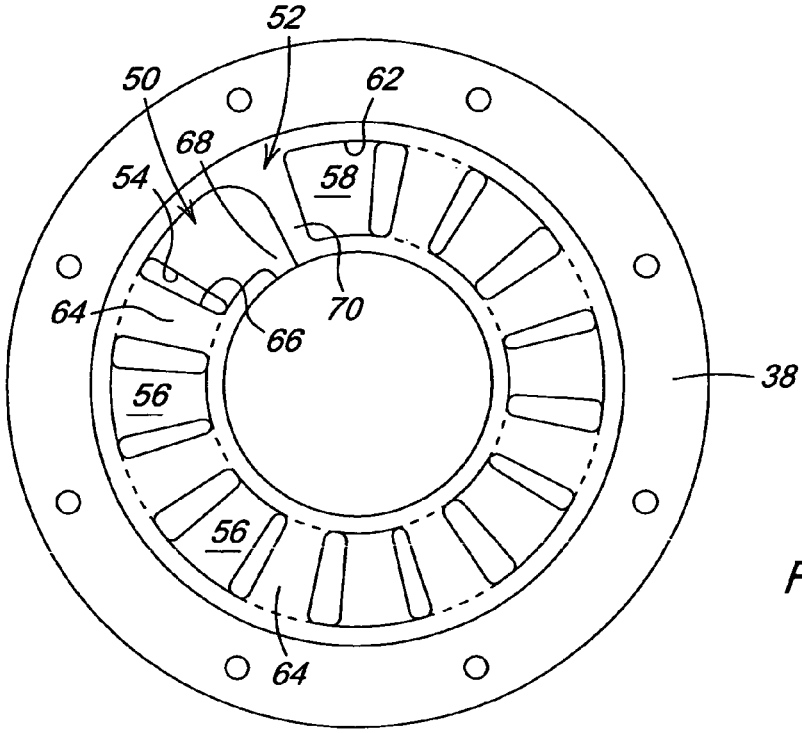
FIG. 7 is a view showing the plates illustrated in FIGS. 5 and 6 mounted together to form a path for carrying water about the mounting flanges of the combustion and mixing chambers and for directing the water into the zone between the chambers.

Referring now to FIGS. 5–7, there is shown another embodiment wherein two circular spacer plates 50 and 52 (see FIG. 7) are used to define a path for water to flow from the injection port 40 into the zone 30 containing hot exhaust gases. Specifically, the spacer plate 50 (FIG. 5) has an outer diameter equal to the inner diameter of the flange gasket 38 and is shown positioned within the gasket 38 and against the flange 34 of the steam generator body 12. The spacer plate 50 has a thickness approximately equal to half that of the flange gasket 38. The spacer plate 50 is provided with seven identical openings 54 which are spaced 45° from each other about the center of the plate 50, and which are separated by identical webs or spokes 56, except at a region centered approximately about a ten o'clock position wherein a web or spoke 58 having a size equal to two of the webs 56 plus one of the openings 54 is provided. The web 58 is positioned so that it is in confronting relationship to the water injection port 40 located in the flange 36 of the elbow 20.

In FIG. 6, the second circular spacer plate 52, which has the same outside diameter as does the spacer plate 50, is shown positioned against the flange 36 of the elbow 20. The spacer plate 52 contains seven identical openings 62 which are spaced 45° from each other and sized like the openings 54 of the spacer plate 50, with the openings 62 being bordered by radially extending webs or spokes 64. When installed (see FIG. 7), the spacer plate 52 is indexed 45° relative to the spacer plate 50 so that the webs 56 of the spacer plate 50 are disposed centrally across the openings 62 of the spacer plate 52, and so that the webs 64 of the spacer plate 52 are disposed centrally across the openings 54 of the spacer plate 50. In the region next to the water injection port 40, the spacer plate 52 is provided with an opening 66 sized slightly larger than the other openings 62, by an amount about half the size of the webs 64, and having a radially inner corner coupled to a passage 68 that extends radially to an inner diameter of the plate 52. A web 70 bordering the side of the passage next to the passage 68 is about half the size of the webs 64.

Like the spacer plate 50, the spacer plate 52 has a thickness about half that of the flange gasket 38 so that when the gasket 38 and the plates 50 and 52, as shown in FIG. 7, are clamped between the flanges 34 and 36, a water path is defined which permits water to flow clockwise from the injection port 40 over the portion of the web 58 that is rightward of the web 70. From there, water flows alternately under webs 64 of the plate 52 and over webs 56 of the plate 50, and finally exits through the radial passage 68. It is to be understood that the particular hole pattern provided in the spacer plates 50 and 62 is only exemplary and that a large variety of patterns could be used that would result in effective cooling of the flanges 34 and 36.

Figure 8:
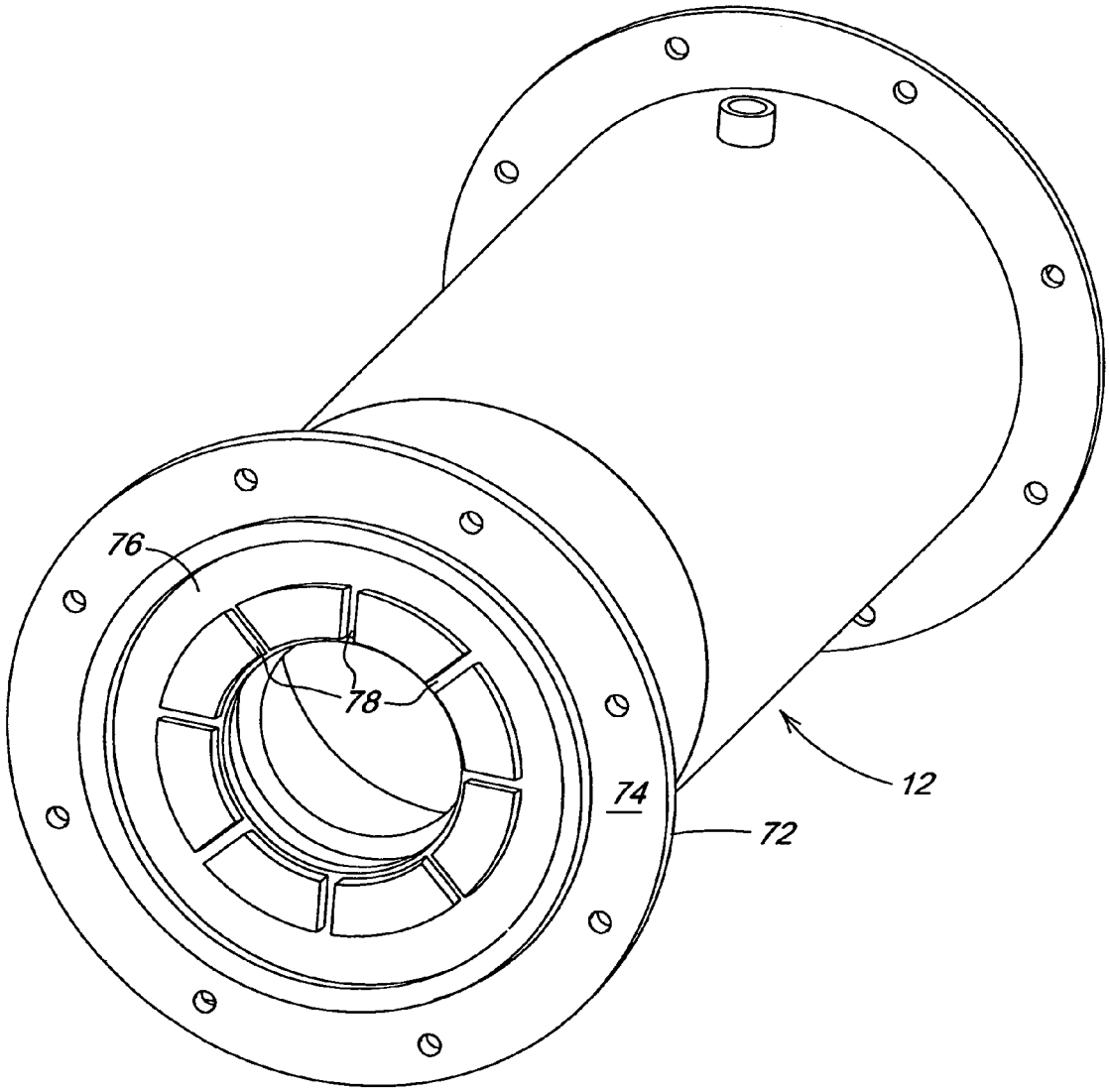
FIG. 8 is a view like FIG. 3, but replacing the spacer plate with a raised C-shaped surface formed integrally with the flange.

Referring now to FIG. 8, a further embodiment is shown wherein a flange 72 is provided at the end of the steam generator body 12 which differs from the previously described flange 34 in that an outer annular portion 74 of the flange 72 is made of a lesser thickness than the remainder of the flange so as to define a seat for receiving the flange gasket 38. Spaced radially inward of the flange gasket 38 at a location chosen so that it is directly opposite from the water injection port 40, is an annular recess 76. A plurality of radially extending water passages 78 couple the recess 76 to the center of the flange 72 so that when the flanges 36 and 72 are clamped in sandwiching relationship to the gasket 38, the face of the flange 36 cooperates with the recess 76 to define an annular passage for conveying water in a circular path where it contacts and cools both flanges 36 and 72. The passages 78 are sized so that water will fill the recess 76 before flowing radially into the zone 30 where it is contacted by hot exhaust gases and changed to steam there or subsequently as it becomes more thoroughly mixed with the hot gases. It is to be understood that the shape of the recess 76 is only exemplary and that a large variety of recess patterns may be used and still accomplish effective cooling of the flanges 36 and 72.

It will be appreciated that no matter what water injection scheme is used at the flange joint between the steam generator body 12 and the elbow 20 for injecting water into the steam generator, water is injected through a port beyond that of the flame area, thereby eliminating all of the problems associated with water flowing on the inside surface of the combustion chamber 28.

Having described the preferred embodiment, it will become apparent that various modifications can be made without departing from the scope of the invention as defined in the accompanying claims.

The invention claimed is:

1. In a direct-fired steam generator including a steam generator body defining a main combustion chamber having an outlet end through which hot gases are exhausted from the combustion chamber, a mixing chamber having an inlet end coupled for receiving the hot gases from the combustion chamber, and a water injection arrangement for injecting water into a zone at said outlet for being contacted by said hot gases and changed to steam, the improvement comprising: a first mounting flange fixed to said generator body in the vicinity of said outlet; a second mounting flange fixed to said mixing chamber at said inlet end; said first and second flanges being secured together to form a flange joint coupling said steam generator body to said mixing chamber; a water injection port being provided in one of said flanges; and a water passage being defined between said flanges in a location in fluid communication with said water injection port and extending completely about said zone; and at least one injection passage coupling said water passage to said zone for causing metering water into said zone for being changed to steam.

2. The direct-fired steam generator, as defined in claim 1, wherein said water passage includes at least one recess provided in a surface of one of said first and second flanges and cooperating with a surface of another of said first and second flanges to define said water passage.

3. The direct-fired steam generator, as defined in claim 2, wherein said recess is formed annularly about an axis of said generator body, and at least one injection passage coupling said recess in fluid communication with said zone.

4. The direct-fired steam generator, as defined in claim 1, wherein an annular flange gasket is provided between confronting surfaces of said first and second flanges; an annular spacer plate having an outer diameter less than an inner diameter of said flange gasket and being mounted between said flanges so as to cooperate with said flange gasket and first and second plates so as to define said water passage; and said spacer plate having a gap located therein for defining said injection passage.

5. The direct-fired steam generator, as defined in claim 4, wherein said spacer plate has a thickness approximately equal to that of said flange gasket.

6. The direct fired steam generator, as defined in claim 5, wherein said annular spacer plate is provided with a radially extending bridge section at said gap which traverses said water passage at a location adjacent to said water injection port, whereby said bridge section prevents water from recirculating through said water passage.

7. The direct-fired steam generator, as defined in claim 4, wherein an annular flange gasket is provided between confronting surfaces of said first and second flanges; an annular spacer plate having an outer diameter less than an inner diameter of said flange gasket and being mounted between said flanges so as to cooperate with said flange gasket and first and second plates so as to define said water passage; and said spacer plate having a thickness slightly less than that of said flange gasket, whereby water flows radially over said spacer plate from said water passage to said zone.

8. The direct fired steam generator, as defined in claim 1, and further including an annular flange gasket located between said first and second flanges; first and second annular spacer plates having outer diameters located at an inner diameter of said flange gasket; said first and second annular spacer plates each being provided with a pattern of holes bordered by webs, with the holes and webs of said first spacer plate cooperating the holes and webs of the second spacer plate so as to define said water passage and said injection passage.

9. The direct fired steam generator, as defined in claim 8, wherein said first and second spacer plates include cooperating web structures which prevent water from recirculating once it has circulated from said injection port to said water injection passage.

10. In a direct-fired steam generator including a steam generator body defining a main combustion chamber having an outlet end through which hot gases are exhausted from the combustion chamber, and an exit conduit having an inlet end coupled for receiving the hot gases from the combustion chamber, the improvement comprising: said generator body having a cylindrical cross section and including a conical exit end section tapering gradually inwardly to said outlet end and a first mounting flange surrounding said outlet end; said inlet of said exit conduit having a diameter equal to that of said outlet end and said exit conduit being provided with a second mounting flange surrounding said inlet; said first and second flanges being secured together to form a flange joint coupling said steam generator body to said exit conduit and surrounding a zone at a lower end of said generator body; a water injection port being provided in one of said flanges; and a water passage being defined between said flanges in a location in fluid communication with said water injection port and extending substantially completely about said zone; and at least one injection passage coupling said water passage to said zone for causing water to be metered into said zone for being changed to steam when contacted by said hot gases.

* * * * *